United States Patent [19]

Drews et al.

[11] 4,239,022

[45] Dec. 16, 1980

[54] METHOD AND APPARATUS FOR FUEL CONTROL OF AN INTERNAL COMBUSTION ENGINE DURING COLD-STARTING

[75] Inventors: Ulrich Drews, Vaihingen-Pulverdingen; Michael Horbelt, Schwieberdingen; Hans Schnürle, Walheim; Peter Werner, Stuttgart; Otto Glöckler, Renningen; Dieter Günther, Murr; Richard Bertsch, Asperg, all of Fed. Rep. of Germany

[73] Assignee: Robert Bosch GmbH, Stuttgart, Fed. Rep. of Germany

[21] Appl. No.: 901,674

[22] Filed: May 1, 1978

[30] Foreign Application Priority Data

Jun. 24, 1977 [DE] Fed. Rep. of Germany ..... 2728414

[51] Int. Cl.[3] ..... F02B 3/00

[52] U.S. Cl. ..... 123/491

[58] Field of Search ..... 123/32 EG, 179 L

[56] References Cited

U.S. PATENT DOCUMENTS

| | | | |
|---|---|---|---|
| 3,616,784 | 11/1971 | Barr | 123/32 EG |
| 3,628,510 | 12/1971 | Moulds | 123/32 EG |
| 3,716,034 | 2/1973 | Schmid | 123/32 EG |
| 3,734,067 | 5/1973 | Glöckler | 123/32 EG |
| 3,792,693 | 2/1974 | Luchaco | 123/32 EG |
| 3,812,830 | 5/1974 | Traisnel | 123/32 EG |
| 4,096,833 | 6/1978 | Sweet | 123/32 EG |
| 4,114,570 | 9/1978 | Marchak | 123/32 EG |

*Primary Examiner*—Ronald B. Cox

*Attorney, Agent, or Firm*—Edwin E. Greigg

[57] ABSTRACT

The cyclic control pulses for actuating the fuel injection valves of an internal combustion engine are extended during engine starting at low temperatures. The degree of pulse extension, i.e. of fuel enrichment, is made dependent on engine temperature and decreases as a function of cranking time. In addition, a repeated starting attempt will be accompanied by reduced pulse extension to prevent excessive enrichment of the mixture. The pulse extension may also be retained for a period of time after engine cranking to insure smooth running.

10 Claims, 11 Drawing Figures

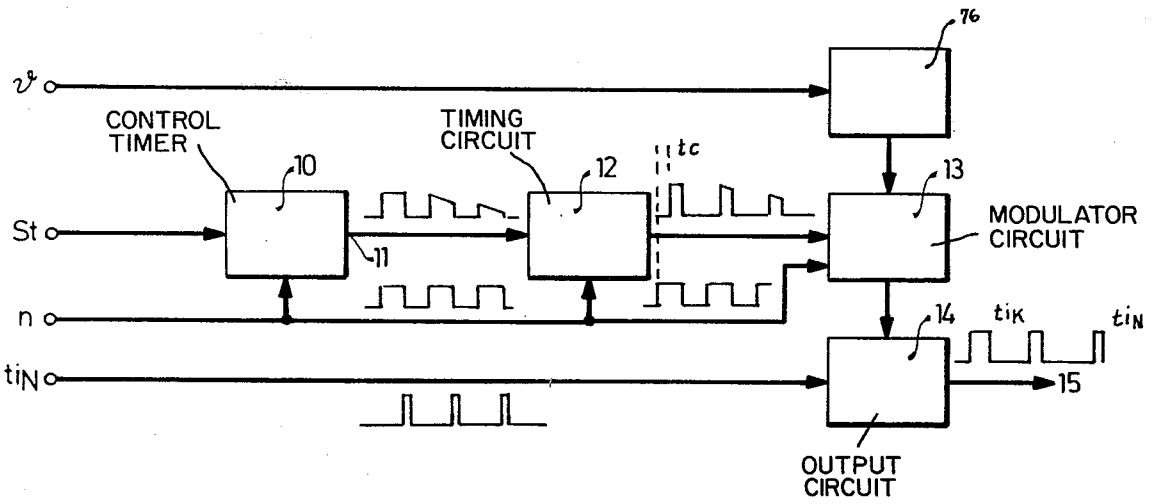
Fig. 1
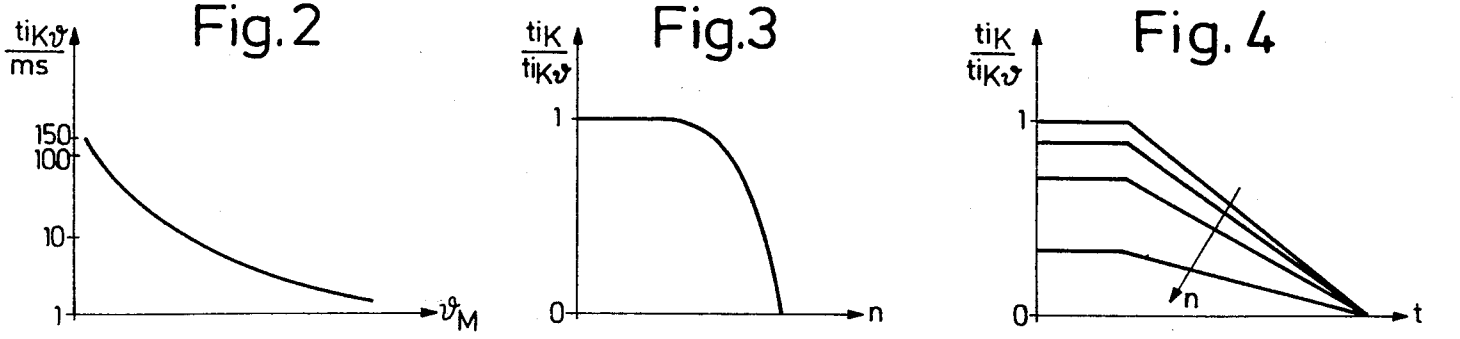
Fig. 2
Fig. 3
Fig. 4

METHOD AND APPARATUS FOR FUEL CONTROL OF AN INTERNAL COMBUSTION ENGINE DURING COLD-STARTING

BACKGROUND OF THE INVENTION

The invention relates to the field of fuel management in internal combustion engines. More particularly, the invention relates to a method and apparatus for raising the supply of fuel delivered to the engine during engine starting, especially when the engine is cold. The invention relates particularly to the field of fuel injection systems controlled on the basis of engine information.

In known apparatus for fuel control, the problem of starting a cold engine is attempted to be solved by providing a supplementary fuel injection valve for cold starting which is actuated during starting when the engine temperature is sufficiently low. The known apparatus also includes a thermal time switch that terminates the fuel enrichment during engine starting after a certain amount of time has elapsed. It is a disadvantage of the known apparatus that the additional cold starting injection valve increases the cost of construction and it is a further disadvantage that the known apparatus only permits the consideration of a limited number of engine variables for the cold starting enrichment process.

OBJECT AND SUMMARY OF THE INVENTION

It is a principal object of the invention to provide methods and apparatus for starting a cold internal combustion engine. It is a further principal object of the invention to provide improved starting of a fuel-injected internal combustion engine without the provision of a separate cold starting valve, i.e. by special actuation of the existing fuel injection valves. It is yet another object of the invention to provide an engine starting control device which is operable on the basis of temperature and whose effect may be reduced or eliminated on the basis of elapsed time and/or an adjustable engine speed. These and other objects are attained according to the invention by providing an electronic circuit including a control timer circuit which delivers an output signal whose amplitude decreases as a function of time after engine starting. The invention further includes a timing circuit that delivers output control pulses whose duration depends on temperature and engine speed. Yet another feature of the invention is a repeat control which serves to reduce the initially injected fuel quantity during a repeated starting process. It is a further feature of the apparatus according to the invention to continue increased fuel injection even after the engine starter has been released because an additional amount of fuel is required to insure smooth engine operation after disengagement of the starter gear.

The voltage of the output signal from the control timer circuit may be caused to decrease according to a selectable function.

The invention will be better understood as well as further objects and advantages thereof become more apparent from the ensuing detailed description of a preferred exemplary embodiment taken in conjunction with the drawing.

BRIEF DESCRIPTION OF THE DRAWING

FIG. 1 is a simplified block diagram of the apparatus according to the invention;

FIG. 2 is a diagram plotting the initial value of the cold starting control pulses as a function of temperature;

FIG. 3 is a diagram illustrating the normalized cold starting control pulses as a function of engine speed;

FIG. 4 illustrates the normalized cold starting control pulses as a function of time with engine speed as a parameter;

DESCRIPTION OF THE PREFERRED EMBODIMENT

Figure 5:
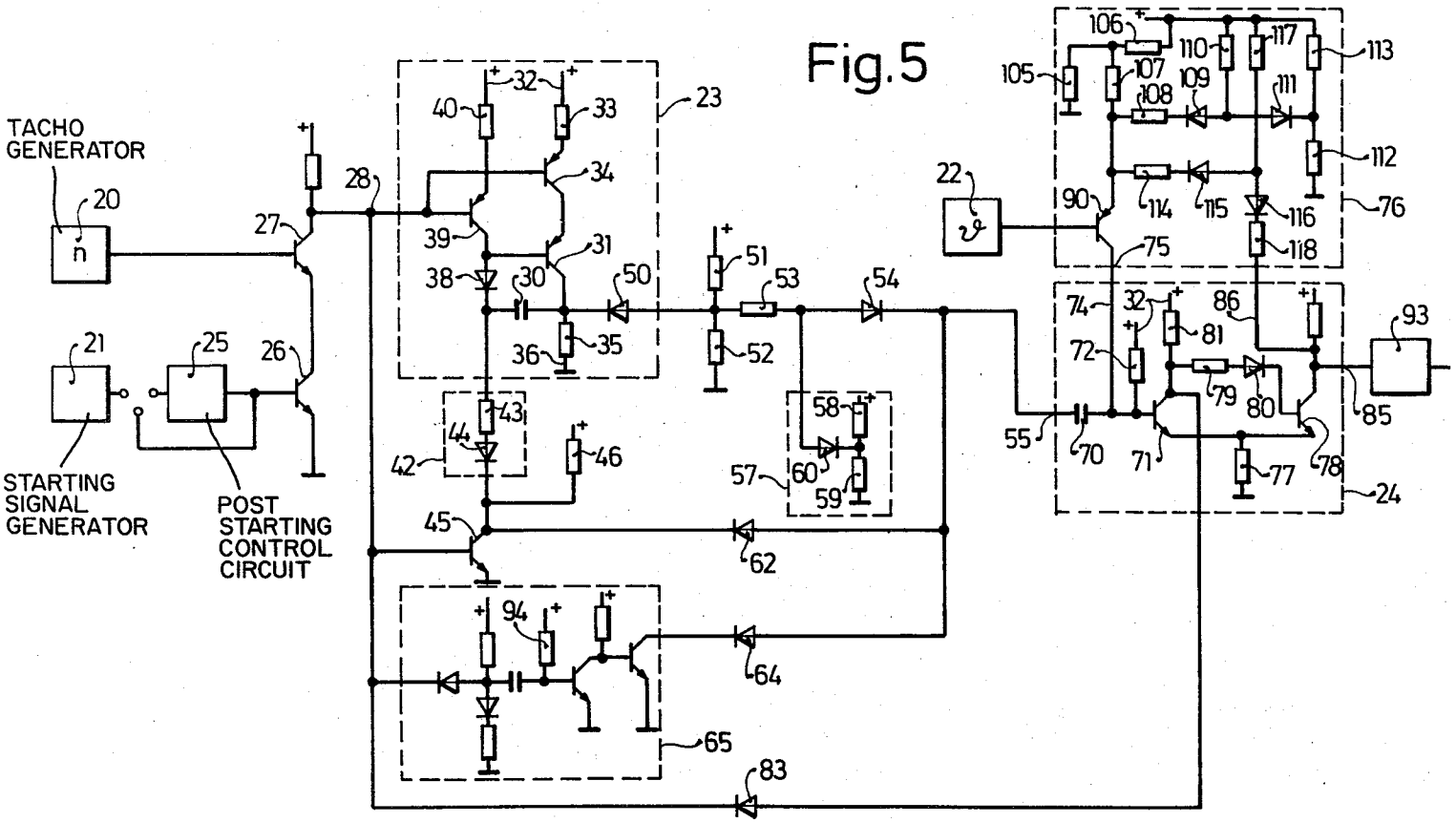
FIG. 5 is a detailed circuit diagram of the apparatus of FIG. 1.

Turning now to FIG. 1, there is illustrated a simplified block diagram of the apparatus according to the invention. The input signals arriving from the left as seen in FIG. 1 are respectively and, read from top to bottom, a temperature signal $\theta$, a starting control signal ST, an engine speed signal n and the normal fuel control pulses tiN. The start signal ST and the engine speed signal n are fed to a control timer 10 having an output 11 which is fed as an input to a timing circuit 12 whose own output in turn is fed to a modulator circuit 13 that generates the cold starting control pulses. The timing circuit 13 also receives the temperature signal $\theta$. The various output pulses are illustrated alongside the circuits which produce them. For example, the output 11 of the control timer 10 is a pulse train whose amplitude is time-dependent, remaining constant for a certain initial time and then decreasing from pulse to pulse. The circuit 12 keys or passes a certain portion of the initial stage of each of the pulses from the control timer 10. Depending on the length and width of the control pulses received by the modulator 13, a capacitor therein is charged to varying degrees. The amount of charge received by the capacitor is rpm-dependent because the duration of the control pulses is rpm-dependent. The output of the pulse generator 13 (modulator) is a set of pulses whose duration is thus dependent on the degree of charging of the capacitor (which in turn depend on the time since starter actuation and the engine speed) as well as on engine temperature. An output circuit 14 is actuated by the control pulses of the pulse modulator 13 and acts as a power amplifier which produces the final actuation pulses for the electromagnetic injection valves 15. The output amplifier 14 also receives the normal fuel injection control pulses tiN. The output pulses from the amplifier 14 are synchronized with the engine speed pulses n so that the net effect of the apparatus is to prolong the duration of the normal fuel injection pulses during engine starting.

The basic engine variables on which the cold starting control depends are illustrated in FIGS. 2–4. The diagram of FIG. 2 shows the duration of the cold starting pulse at the beginning of the starting process as a function of temperature. The cold starting control pulses are seen to be quite long initially, gradually decreasing with increasing temperature according to a predetermined curve.

FIG. 3 is a diagram illustrating the normalized length of the cold starting control pulses as a function of engine speed. The engine speed dependence serves to reduce the injected fuel quantity rapidly when the engine actually catches so as to be adapted to the decreasing amount of air aspirated for each induction cycle during increasing rpm and thus to maintain a combustible mixture even when the engine is rapidly accelerating. After the engine has speeded up beyond a certain rpm, the pulses from the pulse modulator 13 may be entirely suppressed because the normal fuel injection control pulses tiN are sufficient to insure smooth engine operation.

It is further advantageous to make the cold starting control pulses dependent on engine speed. This dependence is illustrated in FIG. 4 where it will be seen that the cold starting enrichment is continuously decreased after a certain time, for example three seconds. This reduction is intended to prevent an excessive enrichment of the mixture which would occur without such a reduction due to the fact that, after a certain time subsequent to engine starting, the cylinder walls are wetted by fuel and prevent the further condensation of fuel. Thus in order to prevent excessive enrichment and maintain combustibility of the mixture, the injected fuel quantity must be reduced.

A preferred exemplary embodiment of the invention is illustrated in a detailed circuit diagram shown in FIG. 5. The basic functional circuit blocks of FIG. 5 are a tacho generator 20, a starting signal generator 21 and a temperature sensor 22. A post-starting control circuit 25 may be coupled to an AND gate consisting of a transistor 26 and a transistor 27. The base of the transistor 27 receives the engine speed control pulses. The output signal of the pair of transistors 26, 27 is fed to a junction point 28 which will be at zero potential if both transistors 26 and 27 conduct at the same time. Thus during starting, i.e. as long as the starter is being actuated, the signal at the point 28 will be a pulse having the frequency of the engine speed tacho generator 20. The control timer 23 includes a Miller integrator consisting of a capacitor 30 and a transistor 31. The transistor 31 is disposed in a current path which starts at the positive supply line 32 and continues in series with a resistor 33, a transistor 34 and a resistor 35 to a ground or negative supply line 36. One side of the capacitor 30 is connected to the junction of the transistor 31 and the resistor 35 and the other side of the capacitor 30 is connected to the positive supply line 32 via a diode 38, a transistor 39 and a resistor 40. The base electrodes of transistors 34 and 39 are both coupled to the junction point 28. Finally, the junction of the capacitor 30 and the diode 38 is connected via a repeat starting control circuit 42 which includes a high-valued resistor 43 and a diode 44 to the collector of a transistor 45 which in turn is connected to the positive supply line via a resistor 46 while the base of the transistor 45 is connected to the aforementioned junction 28. A diode 50 is connected from the junction of the transistor 31 and the resistor 35 to a fixed voltage divider consisting of resistors 51 and 52 connected between the two voltage supply rails. The junction of the resistors 51 and 52 is connected to a further resistor 53 to a diode 54 whose other electrode is connected to the input line of the timing circuit 24. A separate charge-limiting circuit 57 includes a voltage divider consisting of resistors 58 and 59 and a diode 60 connected to their junction as well as to the junction of resistor 53 and the diode 54. Yet another diode 62 connects the input 55 of the timing circuit 24 to the collector of the transistor 45. The input 55 of the timing circuit 24 is further connected via a diode 64 to a pulse processor circuit 65, embodied in this case as a monostable multivibrator, whose other side is connected to the junction point 28.

Within the timing circuit 24, one electrode of a capacitor 70 constitutes the input 55 while the other electrode of the capacitor 70 is connected to the base of a transistor 71. The base of the transistor 71 is connected via a resistor 72 to the positive supply line 32 and further via a line 74 to an output 75 of a temperature-dependent charging circuit 76. The emitter of the transistor 71 is grounded through a resistor 77 and is also connected to the emitter of another transistor 78 whose base is connected to the collector of the transistor 71 through the series connection of a resistor 79 and a diode 80. The collector of the transistor 71 is connected to the positive line through a resistor 81 and through a diode 83 to the junction point 28. The output 85 of the timing circuit 24 is formed by the collector of the transistor 78 which is connected through a supplementary line 86 to the temperature-dependent charging circuit 76 so as to insure immunity against disturbances when the operational voltage fluctuates. The most important element in the temperature-dependent charging circuit 76 is a temperature-dependent current source constituted by connecting the temperature sensor 22 to the base of a transistor 90 whose collector is the output 75 of the circuit. The emitter of the transistor 90 is connected to a number of threshold stages which are intended to generate the temperature-dependence shown in FIG. 2. The threshold stages are formed by voltage dividers of different dimensions connected between the power supply lines. A first voltage divider consists of the resistors 105 and 106 and is connected through a resistor 107 to the emitter of the transistor 90. A further threshold stage is connected by the series coupling of a resistor 110, a diode 111 and a resistor 112 between the positive and negative lines, the resistor 110 and the diode 111 being paralleled by a resistor 113. The junction of the resistor 110 and the diode 111 is connected through a diode 109 and a resistor 108 to the emitter of the transistor 90. A third threshold stage is formed by another diode-resistor connection, i.e. a resistor 114, a diode 115 and a resistor 117, connected between the emitter of the transistor 90 and the positive supply line. The junction of the diode 115 and the resistor 117 is connected through a diode 116 and a resistor 118 to the line 86 leading to the collector of the transistor 78. The circuit 24 feeds a driver circuit which actuates the injection valves.

The apparatus illustrated in FIG. 5 operates in the following manner: The tacho generator 20 and the engine starting signal generator 21 act on the combination of transistors 26 and 27 in such a way that during the actuation of the starter, i.e. while the start signal generator generates a signal, the voltage at the junction point 28 is a signal varying in the cyclic rhythm of the tacho generator output. The control timer 23 contains a controllable Miller integrator with a capacitor 30 and the transistor 31, the charging and discharging cycles of the capacitor 30 taking place in synchronism with the signal at the junction point 28. When the starting signal offered by the generator 21 first occurs, the potential at the junction of transistor 31 and the capacitor 30 is so high that the diode 50 blocks during the occurrence of pulses. The diode 50 blocks because its anode voltage is held to a particular value by the voltage divider 51,52. As time passes, the voltage at the junction of the transistor 31 and the capacitor 30 decreases, the diode 50 begins to conduct and its anode experiences a decreasing voltage. This voltage is passed through the resistor 53 and the diode 54 to the input 55 of the circuit 24 and an additional voltage limitation, i.e. charge limitation for the capacitor 70 takes place due to the charge limiting circuit 57. Thus the capacitor 70 within the modulator circuit 24 receives a time-dependent signal from the control timer 23 which simulates the curve according to FIG. 4.

The modulator circuit 24 includes a known so-called economy monostable multivibrator in which the unstable time period is initiated by signals received via the transistor 45 and the diode 62. A negative pulse or a negative-going edge of a positive pulse puts the transistor 71 into its blocked condition. This increases the collector voltage which results in an increase of the base voltage at the transistor 78, causing the latter to conduct so that the voltage at the output 85 of the timing circuit 24 decays. The capacitor 70 is recharged by the temperature-dependent charging circuit 76 at a temperature-dependent current level. This current raises the voltage at the base of the transistor 71 again, causing it to conduct so that the subsequent transistor 78 blocks and terminates the pause between the pulses at the output 85 of the timing circuit 24.

The output signal from the timing circuit 24 is made rpm-dependent by means of the pulse suppressor circuit 65 which is a monostable multivibrator and generates a pulse suppression signal of constant duration beginning at the onset of a pulse occurring at the junction point 28 and delivers it to the junction 55 via the diode 64. The result of the action of the pulse suppressor circuit 65 is that the output pulses from the control timer 23 whose duration is inversely proportional to engine speed are shortened by a constant amount of time, thereby attaining a very strong rpm-dependence.

If a starting effort is unsuccessful and a renewed starting attempt is made, the amount of fuel initially supplied during the second attempt should be less than that supplied during the first attempt. This reduction is provided by a repeat start circuit 42 which affects the charging of the capacitor 30. The circuit 42 includes a high-valued resistance 43 which permits the discharge of the capacitor even when the engine start signal has terminated and thus defines conditions for a renewed starting attempt. The diode 38 prevents a rapid discharge of the capacitor 30 when the starting switch is open.

The mosulator circuit 24 also includes a threshold switch 78 connected behind the economy monostable multivibrator so as to insure the necessary steepness of the pulse edges for the subsequent driver circuit 93. The connection to the point 28 via the diode 83 serves to increase the immunity against disturbances.

Figure 6:
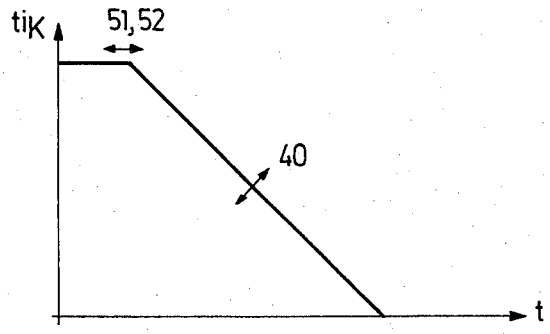
FIGS. 6–10 are diagrams which illustrate which of the elements of the apparatus are to be varied to achieve the illustrated variations of the injection control pulses.

The various curves illustrated in FIGS. 2–4 can be obtained by performing various adjustments in the circuit of FIG. 5. These adjustments are illustrated schematically in the diagrams of FIGS. 6–10. FIG. 6 is a diagram equivalent to FIG. 4, i.e. the fuel increase during starting is plotted as a function of time. The bend in the curve, i.e. the transition from the horizontal portion of the curve to the falling portion, can be defined by determining the ratio of the resistances of resistors 51 and 52, whereas the slope of the decreasing portion can be adjusted by varying the value of the resistor 40 in the control timer 23 because the slope depends on the electrical processes in the Miller integrator which includes the capacitor 30.

Figure 7:
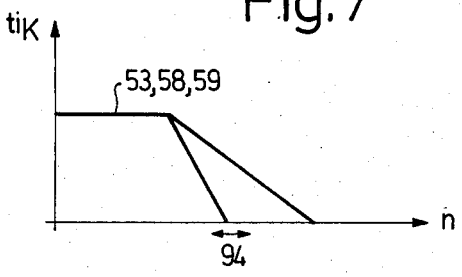

FIG. 7 corresponds to the diagram of FIG. 3 and illustrates the fuel increase during starting as a function of engine speed. The termination of fuel increase may be chosen by adjusting the values of resistors 53 and 94. The resistor 53 determines the amplitude of the charging process in the capacitor 70 while the resistor 94 in the pulse suppressor circuit 65 determines the constant time period during which the pulse reaching the input 55 of the timing circuit 24 is suppressed.

Figure 8:
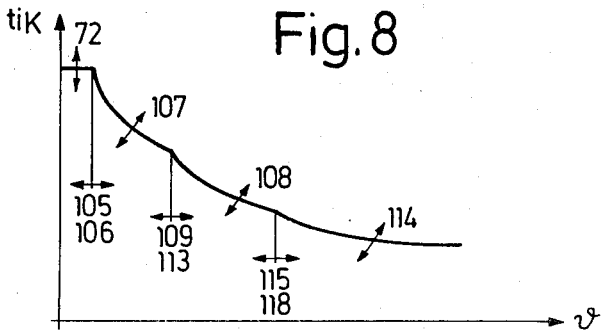

FIG. 8 is a diagram illustrating the initial values of fuel enrichment in dependence on temperature. The curve is composed of a horizontal straight portion and decreasing portions. The straight portion of the curve is defined by the value of the resistor 72 whereas the onset points of the various decreasing portions of the curve as well as the shape of these curves can be adjusted as a function of temperature in the charging circuit 76. The onset times are derived from the ratios of the resistances in the voltage dividers while the slopes of the curves depend on the values of the resistors between the taps of the voltage dividers and the emitter of the transistor 90.

Figure 9:
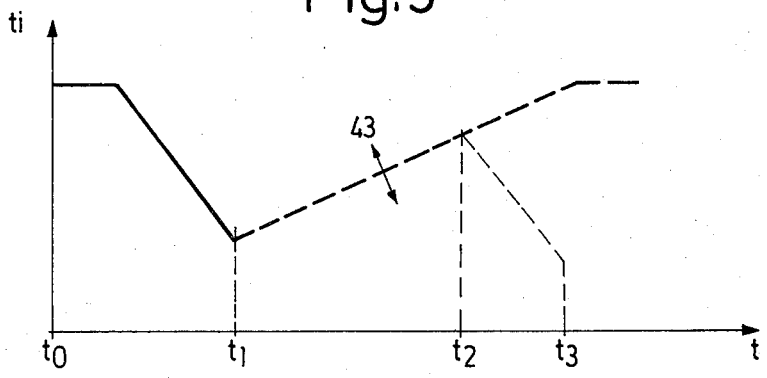

FIG. 9 is a diagram illustrating the effect of the starting repeater circuit 42. The fuel increase is plotted as a function of time in such a way that the initial phase corresponds substantially to the curves according to FIGS. 4–6. The initial starting attempt begins at a time $t_0$ and ends at a time $t_1$. A pause obtains between the times $t_1$ and $t_2$ during which the effective fuel increase again rises at a rate determined by a value of the resistor 43. At the time $t_2$ a second starting attempt is made resulting in the decreasing dashed curve which terminates at the time $t_3$.

The curve in FIG. 9 illustrates that the longer the first starting attempt has lasted and the shorter the time period between successive starting attempts, the lower is the amount of fuel enrichment. This type of behavior is advantageous because it prevents excessive enrichment of the aspirated mixture and insures optimum starting conditions.

Figure 10:
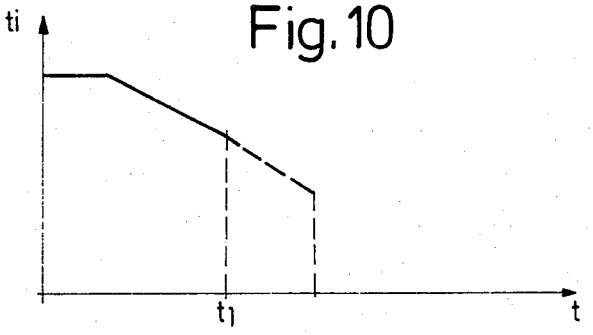

FIG. 10 is a diagram which illustrates the effect of the post-start control circuit 25. The diagram illustrates the fuel enrichment as a function of time. The starting effort is terminated at a time $t_1$ but it is desired that the injected fuel quantity be increased to a limited degree for a certain amount of time. This is obtained by delaying the negative-going edge of the output signal of the start signal generator 21 so that the subsequent transistors 26 and 27 simulate a prolongation of the starting process.

Figure 11:
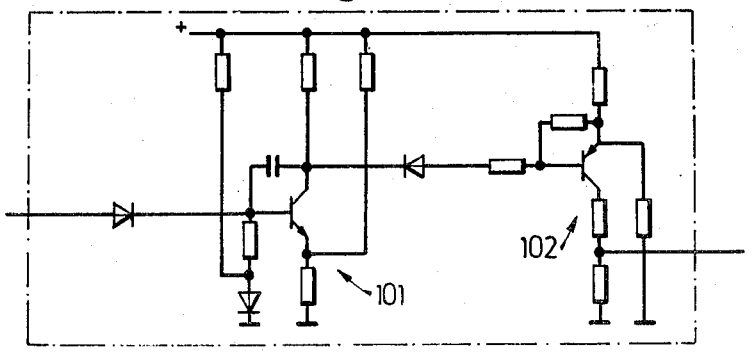
FIG. 11 is a circuit diagram of a post injection control circuit which may be used in the apparatus of FIG. 5.

A circuit which can perform a post-start control process illustrated in FIG. 10 is shown in FIG. 11. The circuit consists substantially of an integrator 101 and a threshold switch 102. This circuit simulates a prolonged starting effort and thus a prolonged fuel enrichment which results in a favorable post-start enrichment of the mixture and a satisfactory acceleration of the engine.

The foregoing relates to preferred exemplary embodiments of the invention, it being understood that other embodiments and variants thereof are possible within the spirit and scope of the invention.

What is claimed and desired to be secured by Letters Patent of the United States is:

1. An apparatus for controlling the fuel supply to an internal combustion engine including at least one fuel injection valve and spark ignition, wherein the apparatus includes an engine rpm sensor, an engine temperature sensor, an engine start-signal generator; wherein the apparatus is further comprises of:

a control timer, axtuated by engine cranking, for generating a train of supplementary pulses synchronized with engine rotation, the amplitude of the supplementary pulses changing with time and wherein the control timer is connected to and receives the output from the engine rpm sensor and the engine start-signal generator;

a trigger pulse suppression circuit which generates a pulse suppression signal, wherein the trigger pulse suppression circuit is connected to the control timer to suppress the supplementary pulses of the control timer, and wherein the trigger pulse suppression circuit is connected to and receives the output from the engine rpm sensor and the engine start signal generator;

a modulator circuit connected to the control timer to receive the supplementary pulses, and wherein the modulator circuit is connected to the trigger pulse suppression circuit to receive the pulse suppression signal, and wherein the modulator circuit is connected to and receives the signal from the engine temperature sensor such that the modulator circuit generates valve control pulses, whose duration depends on engine temperature, engine rpm and engine start.

2. An apparatus as defined by claim 1, wherein said control timer includes at least one sub-circuit providing an integrating effect which takes place only when said control timer receives actuation pulses.

3. An apparatus as defined by claim 1, further comprising a repeat start sub-circuit which has a time-dependent influence on the integration process taking place in said control timer.

4. An apparatus as defined by claim 1, wherein said modulator circuit includes at least one switching element with an associated capacitor and further comprises means for charging and/or discharging said capacitor in temperature-dependent manner.

5. An apparatus as defined by claim 4, wherein the maximum charging time of said capacitor is predetermined.

6. An apparatus as defined by claim 1, further comprising a post start circuit including a timing element, connected behind said control timer for providing an extension of said control pulse after the expiration of engine cranking.

7. An apparatus as defined by claim 1, wherein said modulator circuit includes at least one switching element and an associated capacitor as well as means for charging and discharging said capacitor in temperature-dependent manner, said means including at least one temperature threshold switch.

8. An apparatus as defined by claim 7, wherein the output of said modulator circuit is connected to an input of said means to thereby influence the charging process of said capacitor.

9. An apparatus as defined by claim 1, including an element connected between said control timer and said modulator circuit for suppressing disturbances due to fluctuations in operational voltage.

10. An apparatus as defined by claim 1, wherein said modulator circuit includes a switching transistor connected to a further transistor, said transistors constituting a Schmitt trigger which is connected via a diode to a circuit point constituting an input to said control timer.

* * * * *